US005419475A

United States Patent [19]

Naritomi

[11] Patent Number: 5,419,475

[45] Date of Patent: May 30, 1995

[54] SHOULDER BELT

[75] Inventor: Masanori Naritomi, Urayasu, Japan

[73] Assignee: Taisei Plas Co., Ltd., Japan

[21] Appl. No.: 212,699

[22] Filed: Mar. 11, 1994

Related U.S. Application Data

[63] Continuation of Ser. No. 852,676, Mar. 17, 1992, abandoned.

[51] Int. Cl.[6] ..... A45F 3/02

[52] U.S. Cl. ..... 224/257; 224/264; 2/338; 264/273

[58] Field of Search ..... 224/202, 224, 257, 258, 224/264; 150/107, 108, 110; 190/115; 264/273, 257; 2/267, 268, 338; 450/86; 128/876

[56] References Cited

U.S. PATENT DOCUMENTS

| | | | |
|---|---|---|---|
| 1,055,077 | 3/1913 | Quirk | 224/264 |
| 2,608,326 | 8/1952 | Spector | 224/264 |
| 3,013,919 | 12/1961 | Bialy | 2/338 X |
| 3,115,227 | 12/1963 | Shanok et al. | 2/338 X |
| 3,153,245 | 10/1964 | Silverman | 450/86 X |
| 3,157,246 | 10/1964 | Silverman | 2/338 |
| 3,530,831 | 9/1970 | Loeu | 2/338 X |
| 3,883,053 | 5/1975 | Pritchard et al. | 206/522 X |
| 4,339,488 | 7/1982 | Brokmann | 264/273 X |
| 4,493,865 | 1/1985 | Kuhlmann et al. | 2/16 X |
| 4,645,102 | 2/1987 | Proellochs | 224/178 |
| 4,810,559 | 3/1989 | Fostier et al. | 264/273 X |
| 4,978,044 | 12/1990 | Silver | 224/202 |
| 5,063,615 | 11/1991 | Chernuchin et al. | 2/338 |
| 5,165,113 | 11/1992 | Hyans et al. | 450/86 X |

FOREIGN PATENT DOCUMENTS

| | | | |
|---|---|---|---|
| 423621 | 4/1991 | European Pat. Off. | 2/267 |

*Primary Examiner*—Ernest G. Cusick

*Attorney, Agent, or Firm*—Jordan B. Bierman; Bierman and Muserlian

[57] ABSTRACT

A shoulder belt for suspending a camera, a bag or the like comprises a belt body made of a thermoplastic synthetic resin material, and an accessory member, for example, a shoulder pad or a writing object, e.g., letters or pattern, made of a thermoplastic elastomer, which is rigidly secured to the belt body as an integral part thereof by fusion welding. The shoulder belt exhibits good durability and has beautiful appearance. In addition, the productivity is improved, and the production cost is reduced.

5 Claims, 5 Drawing Sheets

SHOULDER BELT

This application is a continuation of application Ser. No. 07/852,676, filed Mar. 17, 1992, now abandoned.

BACKGROUND OF THE INVENTION

1. Field of the Invention

The present invention relates to a shoulder belt for suspending a camera, a bag, etc. More particularly, the present invention relates to a shoulder belt having an accessory member, such as a pad, a writing object, etc., rigidly secured to the belt body as an integral part thereof.

2. Description of the Prior Art

To suspend a camera, a bag or the like from the shoulder, a shoulder belt is used. When the user is walking, the suspended camera, bag or the like swings, so that the shoulder belt is likely to come off the shoulder. Therefore, a pad serving as a slip-proof member is attached to the shoulder belt. One type of conventional shoulder belt has a pad as a member separate from the belt body, while another type has a pad directly secured to the belt body as an integral part thereof.

In the first type of shoulder belt, the belt body and the pad are likely to move relative to each other, so that the pad is not stable on the shoulder. In the second type, since the pad is secured to the belt body at a fixed position, the pad is stable on the shoulder, so that there is no likelihood of the pad being displaced. Accordingly, the shoulder belt that has the pad secured to the belt body as an integral part thereof is superior from the functional point of view. Incidentally, this type of shoulder belt involves an increase in the man-hour for the process of forming the pad as an integral part of the belt body, and hence a considerably high production cost. For this reason, there has heretofore been a demand for a method of producing a shoulder belt at reduced cost, that is, a technique of forming a pad as an integral part of the belt body with high productivity.

In particular, a conventional method of uniting a pad with the belt body by using a sewing machine cannot provide an adequate peel strength for the pad attached to the belt body because the fastening depends only on the strength of thread. Particularly, when bent, the pad becomes arcuate, pulling a part of the sewing thread, so that this part of the thread may become slack or disconnected. If the thread is broken, a part of the pad peels off, and the peeling spreads chain-reactionally, resulting in the whole pad peeling off the belt body completely. In terms of appearance, the obverse and reverse sides of the pad are different in the seam pattern and therefore distinguishable from each other, which is disadvantageous from the decorative point of view.

In the meantime, many shoulder belts of the type described above are printed with the trade names and manufacturers' names of articles suspended by the belts, e.g., bags, cameras, etc. Shoulder belts printed with such names have a great decorative effect. In particular, shoulder belts printed with famous brands are popular with young people.

Hitherto, silk screen printing has generally been employed to print shoulder belts with letters, for example, trade names, or other patterns. This method enables letters and patterns to be printed on shoulder belts with relative ease. However, the letters or patterns printed by this method come off partially or entirely during the use of the shoulder belts for a long time.

SUMMARY OF THE INVENTION

In view of the above-described circumstances, it is an object of the present invention to provide a durable shoulder belt having an accessory member, e.g., a pad, or a writing object, e.g., letters or patterns, firmly bonded to the belt body.

It is another object of the present invention to provide a shoulder belt having beautiful appearance.

It is still another object of the present invention to provide a shoulder belt of high productivity.

To these ends, the present invention provides a shoulder belt comprising: a belt body made of a thermoplastic synthetic resin material; and an accessory member made of a thermoplastic elastomer, for example, a shoulder pad or a writing object, which is rigidly secured to the belt body as an integral part thereof by fusion welding. It is more preferable to secure the accessory member to the belt body as an integral part thereof by injection molding process.

Preferable examples of the thermoplastic synthetic resin material are nylon and polypropylene. If the belt body is formed from a knitted fabric, the accessory member can be secured thereto even more firmly. The accessory member may be fusion-welded to the belt body as an integral part thereof through a hole punched in the belt body.

With the above-described arrangement, the present invention enables the pad to be firmly secured to the belt body, whereas the prior art that uses a sewing machine depends only on the strength of thread, so that the peel strength of the pad attached to the belt body is enhanced. In addition, the present invention is free from the problem that when the pad is bent, a part of the sewing thread is pulled to become slack or disconnected, so that a part of the pad peels off and the peeling spreads chain-reactionally, resulting in the whole pad peeling off the belt body. Since a writing object such as letters is attached to the belt body as an integral part thereof by fusion welding and not by silk screen printing as in the prior art, there is no likelihood that the writing object will come off easily.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which:

FIG. 3(*b*) is a partly-cutaway perspective view of a shoulder belt with a pad fusion-welded by injection molding;

FIG. 3(*c*) is a partly-cutaway perspective view of a shoulder belt with a pad insert-molded by injection molding process after primer coating process;

FIG. 4(*b*) is a sectional view taken along the line IVb—IVb in FIG. 3(*b*);

FIG. 4(*c*) is a sectional view taken along the line IVc—IVc in FIG. 3(*c*);

DETAILED DESCRIPTION OF THE EMBODIMENTS

Preferred embodiments of the present invention will be described below in detail with reference to the accompanying drawings.

Figure 1:
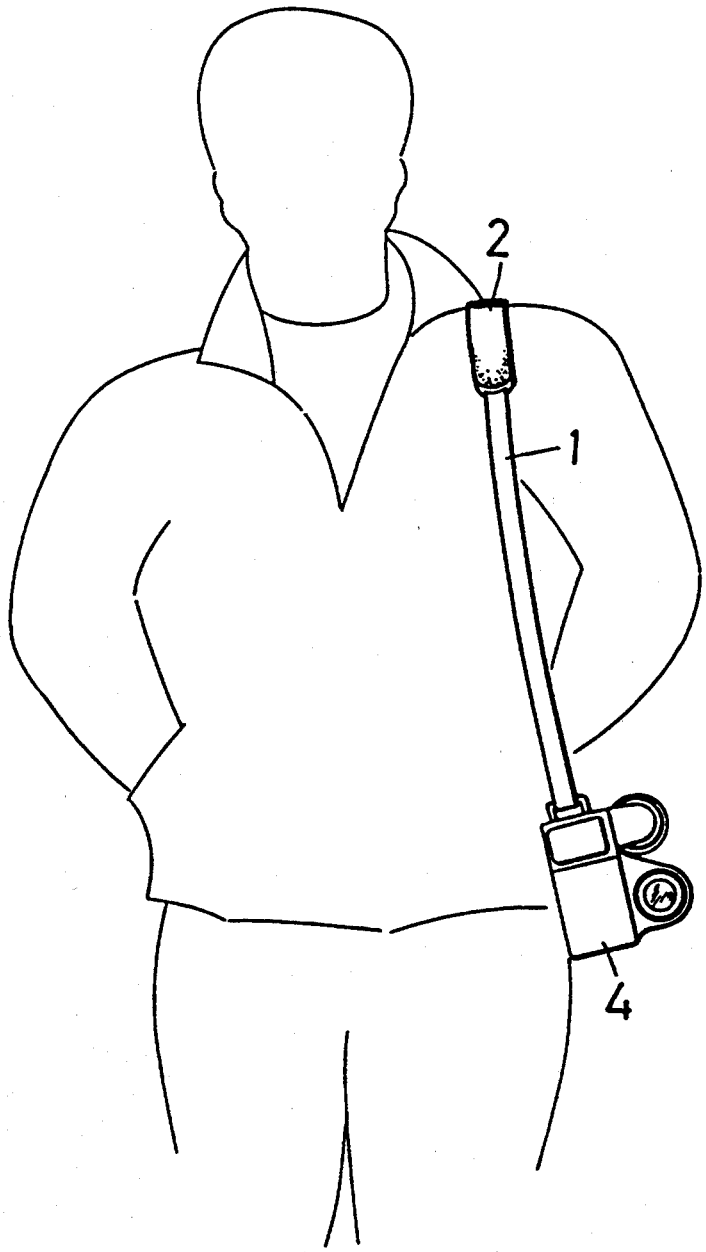
FIG. 1 shows the way in which a camera is suspended from the shoulder by using a shoulder belt united with a pad according to the present invention.
Figure 2:
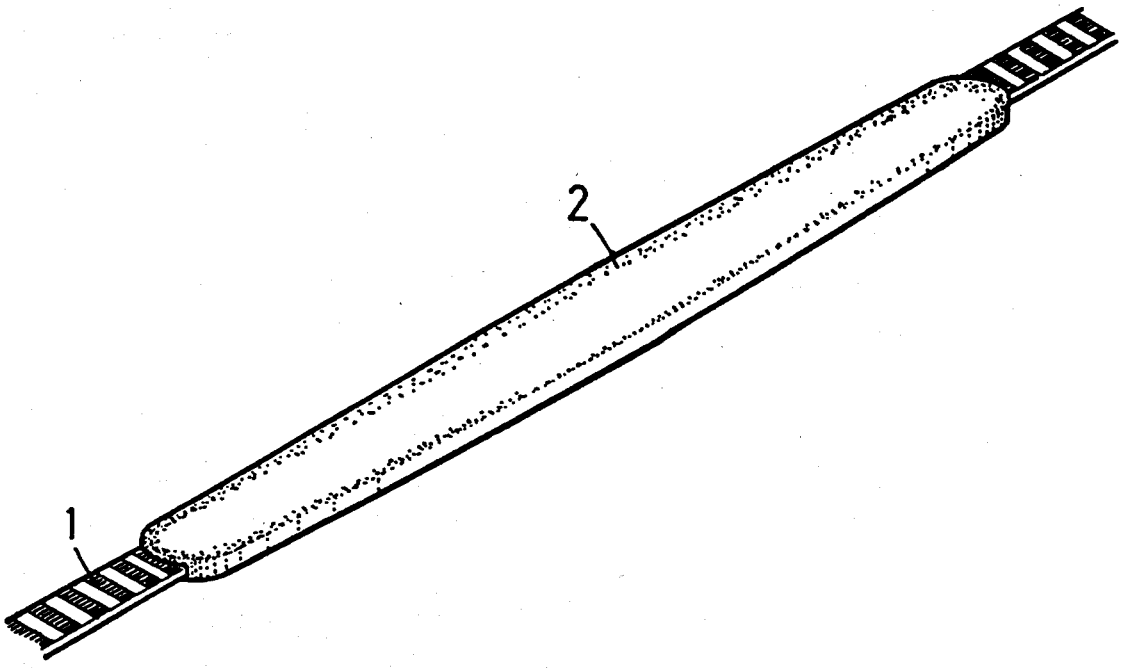
FIG. 2 is an enlarged perspective view of the shoulder belt shown in FIG. 1.

FIG. 1 shows the way in which a camera 3 is suspended from the shoulder by using a shoulder belt of the present invention, which comprises a belt body 1 and a pad 2 attached thereto as an integral part thereof. FIG. 2 is an enlarged view of the shoulder belt shown in FIG. 1.

Figure 3A:
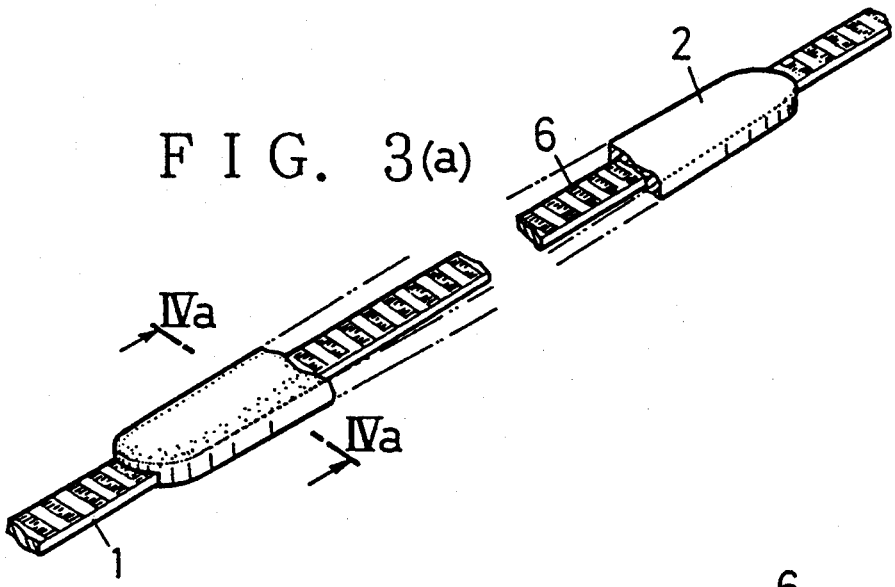
FIG. 3(*a*) is a partly-cutaway perspective view of a shoulder belt with a pad insert-molded by injection molding process.
Figure 3B:
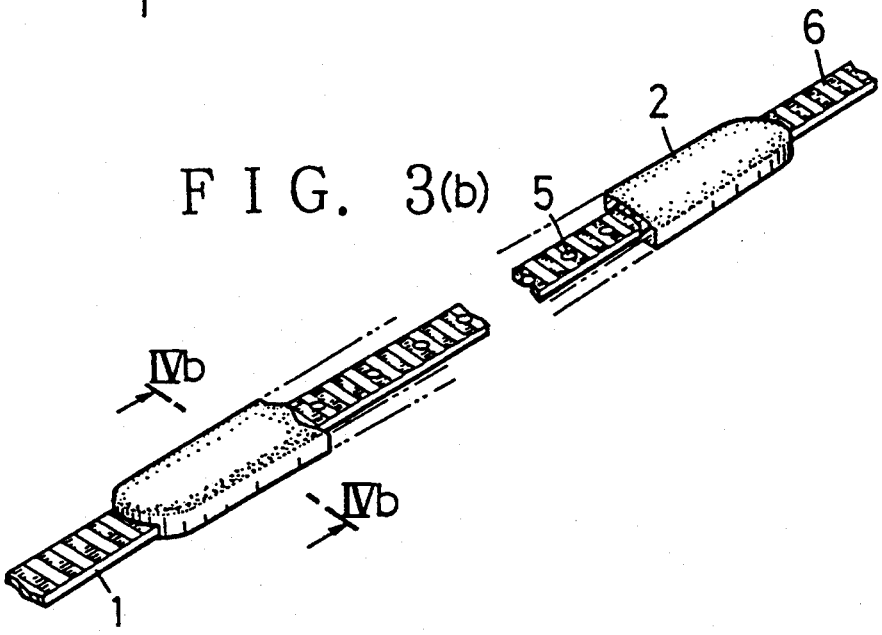
Figure 3C:
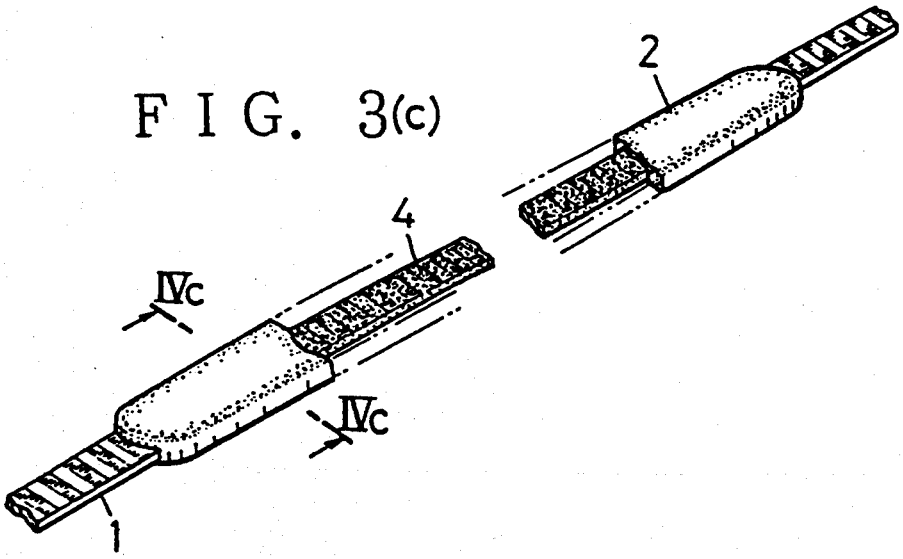
Figure 4:
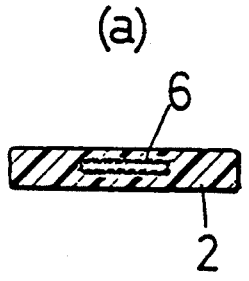
FIG. 4(*a*) is a sectional view taken along the line IVa—IVa in FIG. 3(*a*)
Figure 4:
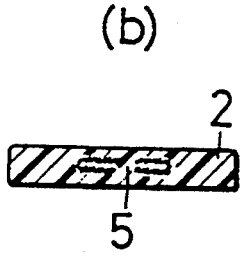
Figure 4:
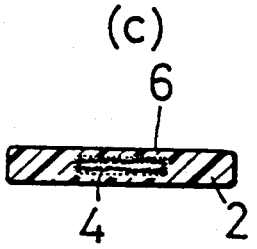

FIGS. 3(*a*), 3(*b*) and 3(*c*) are fragmentary perspective views each showing a shoulder belt with a pad 2 insert-molded by injection molding process. FIGS. 4(*a*), 4(*b*) and 4(*c*) are sectional views of the shoulder belts shown in FIGS. 3(*a*), 3(*b*) and 3(*c*), respectively.

FIG. 3(*a*) shows a shoulder belt having a pad 2 attached to a belt body 1 by injection molding process without the belt body 1 being subjected to any particular processing beforehand. A woven or knitted fabric is used as a material for the belt body 1. Since a woven or knitted fabric has irregularities 6 in the surface, a molten thermoplastic elastomer used as a pad material flows into the irregularities 6, so that the pad 2 is rigidly bonded to the belt body 1 effectively and reliably.

FIG. 3(*b*) shows a shoulder belt having a pad 2 attached to a belt body 1 by injection molding process with holes 5 punched in the belt body 1 in advance. In this case, the molten pad material enters and fills the holes 5, so that the pad 2 is rigidly bonded to the belt body 1 through the holes 5 in such a manner as to sandwich it from both sides thereof. In the case of the belt body 1 formed from a woven or knitted fabric, the welded pad material bites into the irregularities in the surface of the belt body 1, so that the pad 2 is bonded to the belt body 1 even more firmly.

FIG. 3(*c*) shows a shoulder belt having a pad 2 attached to a belt body 1 by injection molding process with a primer 4 coated on the belt body 1 in advance. By virtue of the primer coating process, the pad 2 is bonded to the belt body 1 even more firmly, and the belt body 1 can be formed by using a material other than thermoplastic synthetic resin materials, e.g., leather or natural fiber. As the primer 4, silicon may be used, but it is a matter of course that an optimal primer may be properly selected by taking into consideration the properties of materials used for the pad 2 and the belt body 1.

In each of the foregoing embodiments, the injection molding of the pad 2 is carried out in the same way as in the known insert injection molding process. That is, with the belt body 1 placed in a mold, a pad material, which is a molten thermoplastic elastomer, is injected into the cavity in the mold. The molten thermoplastic elastomer injected into the cavity fuses a part of the surface of the belt body 1 or the primer 4 by its own heat, so that the molten thermoplastic elastomer and the fused belt body material or primer mix or cohere with each other to form a fusion weld junction. Thereafter, the belt body 1 having the pad 2 rigidly united therewith is removed from the mold, and then other necessary processing is executed to complete a shoulder belt.

Injection molding is advantageous in that the configuration of the pad 2 can be varied by changing molds from one to another. Since a multi-cavity mold can be used for the pad 2 of the shoulder belt, which is relatively small, the productivity is improved. Examples of thermoplastic synthetic resin materials usable for the belt body 1 are nylon, polypropylene, ABS, polycarbonate, etc., which are preferable from the viewpoint of strength and wear resistance.

Since the pad 2 is put directly on the shoulder, a relatively elastic material is suitably employed therefor, that is, one selected from among thermoplastic elastomers such as urethane elastomers, olefin elastomers, diene elastomers, plasticized polyvinyl chloride, etc. A pad material which is particularly noteworthy in the present invention is a thermoplastic elastomer that contains either polyether block amide or a polyester thermoplastic elastomer. Since such a pad material can be bonded or welded to almost any kind of material selected for the belt body 1, materials for the pad 2 and the belt body 1 can be combined with an extremely high degree of freedom.

It is preferable to use a pad material obtained by mechanically blending 25 to 185 parts by weight, particularly preferably 40 to 60 parts by weight, of polyether block amide with 100 parts by weight of a thermoplastic elastomer such that the former is uniformly dispersed in the latter [see Japanese Patent Application Laid-Open (KOKAI) Nos. 1-139240 (1989) and 1-139241 (1989)].

It is also preferable to use a pad material obtained by mechanically blending 25 to 185 parts by weight, particularly preferably 40 to 60 parts by weight, of a polyester thermoplastic elastomer with 100 parts by weight of a thermoplastic elastomer such that the former is uniformly dispersed in the latter, as proposed by the present applicant in Japanese Patent Application No. 1-235620 (1989).

Figure 5:
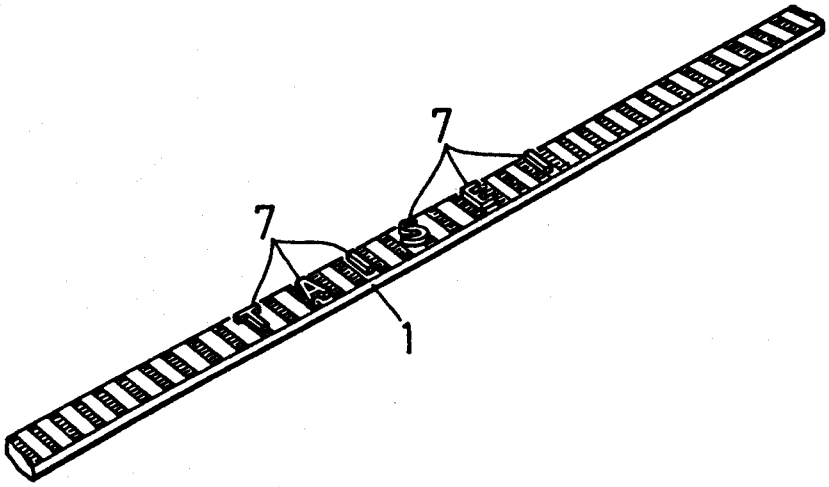
FIG. 5 is a fragmentary perspective view of a second embodiment of the shoulder belt according to the present invention which is united with a writing object by injection molding.

FIG. 5 is a fragmentary perspective view of a second embodiment of the shoulder belt according to the present invention. In this embodiment, a writing object 7, for example, a trade name or a manufacturer's, rigidly bonded to a belt body 1 as an integral part thereof. The writing object 7 is formed by injection molding of a thermoplastic elastomer in the same way as in the foregoing embodiment. At the same time as the molding process is carried out, the writing object 7 is rigidly bonded to the belt body 1 as an integral part thereof. The writing object 7 may be provided not only on one side of the belt body 1 but also on each side thereof. The writing object 7 may also be a figure or a pattern in addition to letters.

Figure 6:
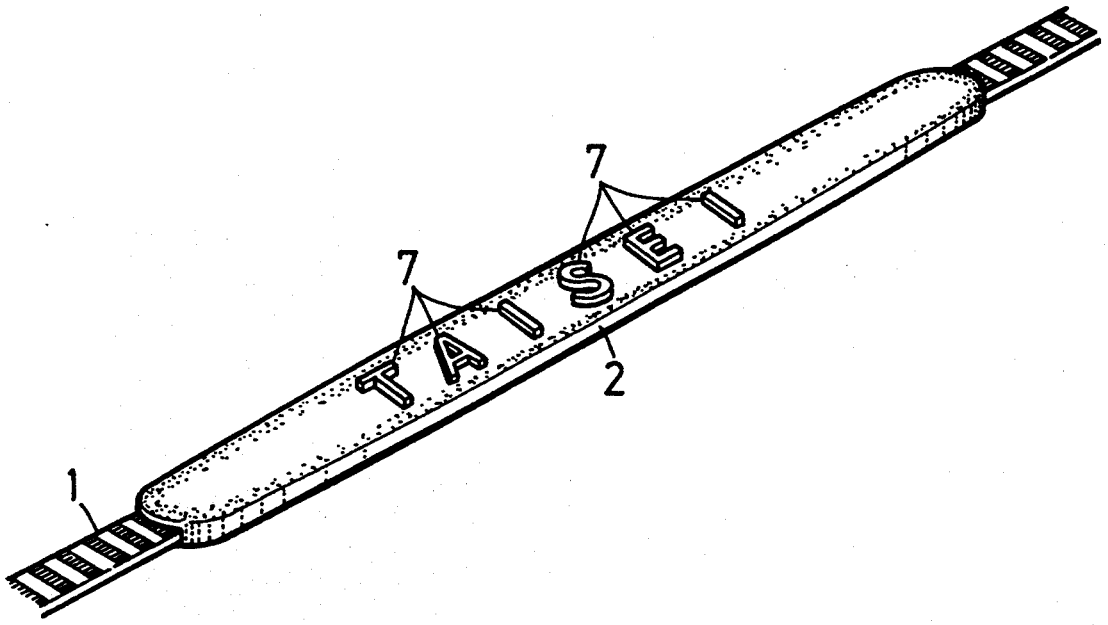
FIG. 6 is a fragmentary perspective view of a third embodiment of the shoulder belt according to the present invention which is united with a pad having a writing object by injection molding.

FIG. 6 is a fragmentary perspective view of a third embodiment of the shoulder belt according to the present invention. In this embodiment, a writing object 7 is provided on the surface of a pad 2. The pad 2 and the writing object 7 are formed by injection molding of a thermoplastic elastomer in the same way as in the foregoing embodiments. At the same time as the molding process is carried out, the pad 2 having the writing object 7 is rigidly bonded to the belt body 1 as an integral part thereof. Accordingly, the same mold is used for molding of the pad 2 and the writing object 7.

The pad 2 and the writing object 7 may be bonded to the belt body 1 not only by the above-described injection molding process but also by a means conformable to the material of the belt body 1, for example, high-frequency dielectric welding, high-frequency induction welding, ultrasonic welding, etc. For example, high-frequency dielectric welding is suitably employed for vinyl chloride, which has a large dielectric loss, whereas ultrasonic welding or hot plate welding is suitably employed for a polyolefin resin, e.g., polyethylene, polypropylene, etc.

As has been detailed above, the present invention enables an accessory member, e.g., a pad or a writing object, to be firmly bonded to the belt body, and it is therefore possible to obtain a shoulder belt that exhibits satisfactory durability.

In addition, the shoulder belt has beautiful appearance, and it requires a reduced number of steps for the production process, so that the productivity is high, while the production cost is low.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A shoulder belt comprising a belt body of thermoplastic material having an upper outer surface and a lower outer surface, a shoulder pad of thermoplastic elastomer rigidly secured to both said upper outer surface and said lower outer surface, by fusion-welding in the presence of a primer, thereby encompassing said belt body, said upper surface, said lower surface, and said pad being secured to one another whereby said pad is integral with said belt body.

2. The shoulder belt of claim 1 wherein said primer is on said belt body.

3. The shoulder belt of claim 1 wherein said belt body is a knitted fabric.

4. The shoulder belt of claim 1 wherein said shoulder pad is fusion-welded to said belt body through a hole in said body, said hole being filled with said elastomer.

5. The shoulder belt of claim 4 wherein said body is of a knitted fabric.

* * * * *